US006840849B2

(12) United States Patent
MacKay

(10) Patent No.: US 6,840,849 B2
(45) Date of Patent: Jan. 11, 2005

(54) MOUNTING DEVICE FOR COATED ABRASIVE FINISHING ARTICLES

(76) Inventor: Joseph H. MacKay, P.O. Box 27497, San Diego, CA (US) 27497

( * ) Notice: Subject to any disclaimer, the term of this patent is extended or adjusted under 35 U.S.C. 154(b) by 0 days.

(21) Appl. No.: 10/398,839

(22) PCT Filed: Dec. 18, 2001

(86) PCT No.: PCT/US01/50905

§ 371 (c)(1),
(2), (4) Date: Jul. 16, 2003

(87) PCT Pub. No.: WO02/060644

PCT Pub. Date: Aug. 8, 2002

(65) Prior Publication Data

US 2004/0005851 A1 Jan. 8, 2004

Related U.S. Application Data

(60) Provisional application No. 60/265,485, filed on Jan. 31, 2001.

(51) Int. Cl.[7] ..... B24D 17/00

(52) U.S. Cl. ..... 451/508; 451/359; 451/360; 451/509; 451/510; 451/514; 451/515; 451/520; 451/521

(58) Field of Search ..... 451/359, 360, 451/508, 509, 510, 514, 515, 520, 521

(56) References Cited

U.S. PATENT DOCUMENTS

| | | | | | |
|---|---|---|---|---|---|
| 4,541,205 | A | * | 9/1985 | Patrello | 451/342 |
| 4,924,634 | A | * | 5/1990 | MacKay, Jr. | 451/342 |
| 5,938,514 | A | * | 8/1999 | Amin et al. | 451/508 |
| 6,379,234 | B1 | * | 4/2002 | MacKay | 451/359 |

* cited by examiner

*Primary Examiner*—Joseph J. Hail, III
*Assistant Examiner*—Shantese McDonald
(74) *Attorney, Agent, or Firm*—Fulbright & Jaworski L.L.P.

(57) ABSTRACT

A reusable mounting device which includes a support member having a support pad (32) secured to a hollow cylindrical body (42) by way of a compression ring (46). The hollow body defines a recess which receives a nut (18) that is adapted to protrude through a central aperture in an abrasive disc (1) and includes an irregular surface (22) providing an interference fit between the nut and the aperture in the disc. The nut extends into the hollow cylindrical member and includes an internal threaded bore adapted for threadable engagement with a drive member (30) which forms a part of or is attached to a portable power tool.

16 Claims, 4 Drawing Sheets

MOUNTING DEVICE FOR COATED ABRASIVE FINISHING ARTICLES

This application is a 371 of PCT/US01/50905 filed Oct. 30, 2001 which claims benefit of 60/265,485 filed Jan. 31, 2001.

FIELD OF THE INVENTION

This invention relates generally to abrasive finishing articles and more particularly, to a mounting device for attaching coated abrasive finishing articles to the drive member of a power tool.

DESCRIPTION OF THE PRIOR ART

The use of rotatably driven abrasive finishing articles and particularly coated abrasive finishing articles such as discs is widespread and familiar in our industrial society. Traditionally, such an abrasive disc is removably attached by way of a hub assembly including a disc support pad to a power tool. When the hub is rotated, the disc rotates with it permitting the moving disc abrasive surface to effectively finish the surface of work pieces. A variety of hub structures have been used in the prior art to secure the abrasive finishing disc to the power tool.

The earliest and very common of such structures includes a support pad having a reinforced central aperture arranged to be engaged over the threaded end of the rotary shaft of the power tool. The abrasive finishing disc is placed on the flat surface of the pad and a flanged nut is turned down onto the threaded end of the rotary shaft protruding through the disc. When the nut is tightened, the flange lays flush against the abrasive surface of the disc and clamps the disc to the support pad.

This traditional mode of attaching the abrasive finishing disc to the rotary power tool has two major disadvantages. The first of these is that in engagement of the rotating finishing disc against the work piece, a large amount of torque is imparted to the hub which tends to tighten the nut onto the threaded shaft of the power tool making it quite difficult to remove the nut in order to replace the disc after it is spent and usually involves the use of tools. In many heavy industrial applications, such abrasive discs have to be replaced quite often. As a result, when considering the number of power tools which may be in use at any given time, there is an excessive amount of downtime necessitated by such disc replacement. The second disadvantage is that the flange of the nut extends onto the above surface of the finishing disc and the worker must be quite careful to prevent the flange on the nut from engaging the work piece which in most cases would impart damage to the work piece.

In order to avoid the problems above referred to, a quick release abrasive finishing disc hub was developed and is most clearly shown in U.S. Pat. Nos. 3,667,169 and 3,667,170. As is disclosed therein, an adapter is provided which engages the power tool shaft and the adapter is placed on a standard support pad. The adapter is typically adhered to the back surface of the abrasive finishing disc and includes a raised boss having a central aperture whose rim is turned inward and shaped to form a screw thread which receives the threaded end of a stud on or the end of the power tool shaft itself. This allows the user to attach or remove the abrasive disc to the power tool rather quickly. However, through the utilization of such devices, the attaching structure is disposable along with the spent disc and therefore, increases the cost of the materials used in the abrasive finishing process.

In view of the foregoing disadvantages of the prior art abrasive finishing disc mounts, it is desirable to provide a mounting device for coated abrasive finishing articles and particularly a coated abrasive finishing disc which is reusable and will provide the ability to the user to quickly and easily remove and mount abrasive finishing discs upon a portable power tool without the need for wrenches, screwdrivers, or other tools and without the attachment of any external adapters or other attachment devices directly to the abrasive finishing discs.

A typical attachment of the type above referred to for securing a coated abrasive disc having a central aperture to the power tool with a nut having flange is shown by the patent to G. L. Bryson, U.S. Pat. No. 2,699,020. An additional type of quick change structure in addition to the patents above referred to which includes an adapter secured to the abrasive discs is shown by the patent to Field, U.S. Pat. No. 3,653,858.

SUMMARY OF THE INVENTION

A mounting apparatus for rotatably securing a coated abrasive finishing article to the drive member of a power tool which includes a support member and a nut adapted to extend through an aperture in the finishing article for engaging the finishing article with the power tool which comprises an outer irregular surface on the body of the nut which is adapted to engage an edge of the aperture through the finishing article in an interference fit and a centrally disposed threaded bore for engagement with the power tool drive member, a support pad is provided defining a centrally located aperture and a face to engage the abrasive finishing article with the support pad having a reduced thickness region adjacent and surrounding the aperture therethrough. The support member further includes a hollow externally threaded cylinder having an outwardly extending flange at one end thereof and a compression ring. The support pad is secured between the flange and the compression ring to secure the support pad upon the cylinder. The end of the cylinder having the flange defines a recess adapter to receive a flange extending outwardly from one end of the nut so that when assembled in operational configuration, the flange on the nut is below the abrasive finishing article surface so that it cannot engage a work piece during use.

DETAILED DESCRIPTION

Figure 1:
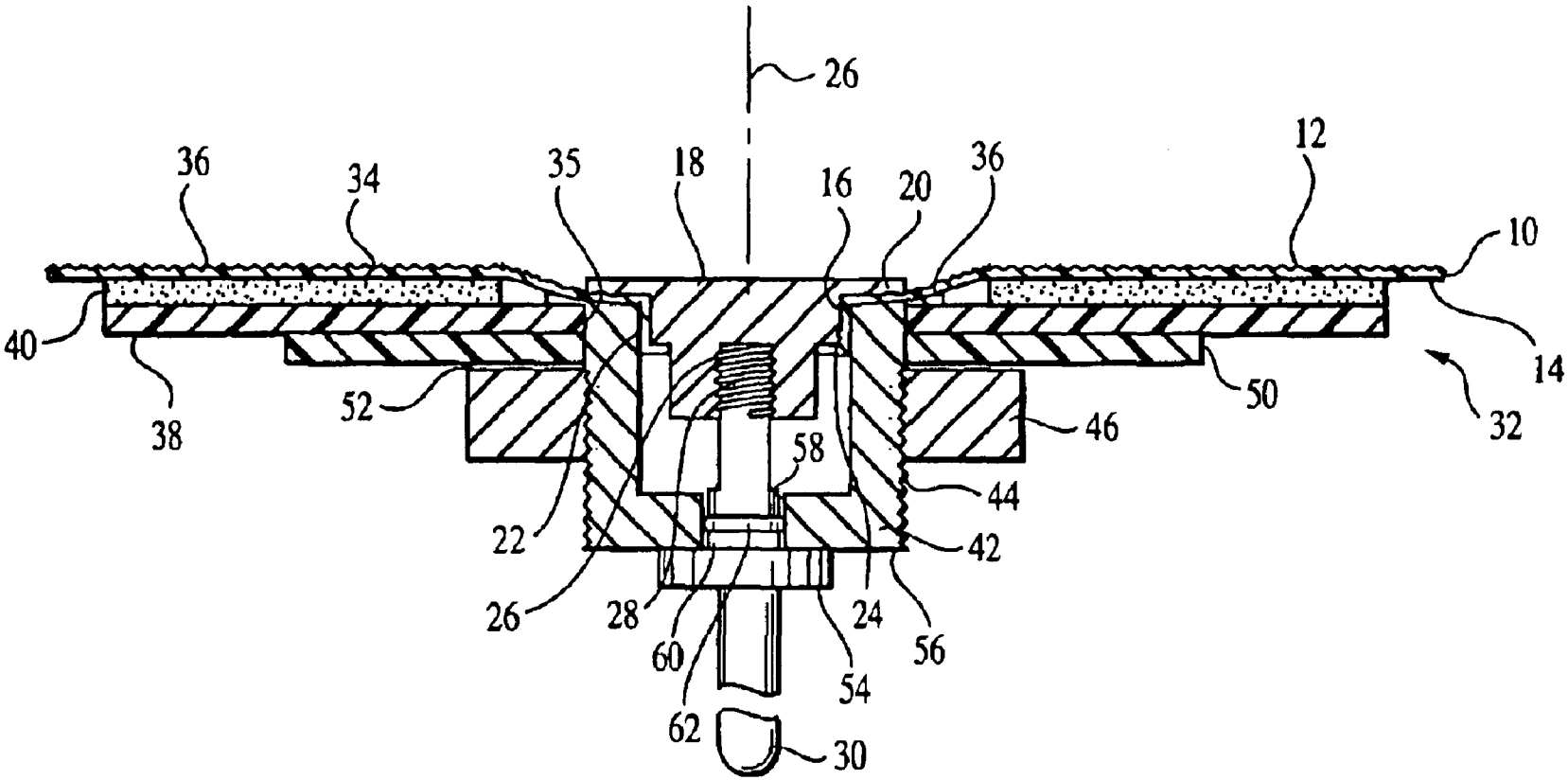
FIG. 1 is a cross-sectional view of an abrasive finishing disc assembled with the mounting device of the present invention.

Referring now more particularly to FIG. 1 there is illustrated schematically in cross-section, a mounting device for coated abrasive discs constructed in accordance with the principles of the present invention with a coated abrasive member secured thereon. As is illustrated in FIG. 1, the support member constructed in accordance with the present invention is adapted to secure an abrasive finishing article 10 in the form of a coated abrasive disc having a first surface 12 with abrasive finishing material thereon and a second uncoated surface 14 on the opposite side thereof. The disc 10 defines an aperture 16 centrally disposed therethrough. A nut 18 having a flange 20 extending outwardly from one end thereof is pushed through the aperture in such a manner that an outer surface 22 having an irregular configuration forms a substantially interference fit with the edge 24 of the aperture. As will be described more fully herein below, the irregular surface may be formed by a plurality of alternating ridges and grooves which may take any shape desired and preferably would be disposed parallel with the axis 26 of the nut. The nut also defines a bore 26 therein which is internally threaded to receive the threaded end 28 of a drive member 30 which is adapted to be affixed to a power tool (not shown) but well known to those skilled in the art. A support pad 32 is provided and has a surface 34 which engages the surface 14 of the abrasive disc 10. The support pad also defines an aperture 35 centrally disposed therethrough. The surface 34 of the support pad 32 immediately adjacent to the opening 35 therethrough has a reduced thickness which is adapted to receive a second flange 36 on a cylinder 42. The support pad 32 in accordance with a preferred embodiment of the present invention useful with smaller discs includes a semi-rigid member 38 which may be formed of plastic having an elastomeric material 40 secured thereto with the elastomeric material 40 engaging the surface 36 of the abrasive disc 10 or alternatively, may be formed solely of elastomeric material. The support member further includes the hollow cylindrical member 42 having an externally threaded surface 44. Threadably secured upon the external surface 44 is a compression ring 46. As is shown, the support pad 32 is disposed upon an outwardly extending lip or flange 36 of the cylindrical member 42. It should be apparent to those skilled in the art that the support pad 32 is captured between the flange 48 and the compression ring 46. It should also be noted that the flange 36 is received within the reduced thickness area of the support pad 32. The end of the cylinder adjacent the flange 36 defines a recess which is adapted to receive the flange 20 on the nut 18 so that when assembled on the mounting device, the flange 20 is below the abrasive finishing articles on the surface 12 of the disc 10 to preclude the flange coming into contact with the work piece.

If desired, an additional backing member or disc 50 may be provided along with the support pad 32 to provide additional rigidity. Depending upon the application and the rigidity desired, the additional backup disc 50 may be constructed of metal. Under those circumstances, it may also be desirable to provide an elastomeric washer 52 which is seated between the metal disc 50 and the compression ring 46 to assist in securing the back pad and supporting discs in proper relation to provide the support desired for the abrasive finishing disc 10.

As is further shown in FIG. 1, the drive member 30 includes a flange 54 which seats against a surface 56 of the cylinder 42. The cylinder 42 defines an opening 58 through which the drive member extends. The portion 60 of the drive member extending through the opening 58 carries an O-ring 62 which provides frictional engagement with the opening 58. Through the frictional engagement, the support member is retained upon the drive member 30 during the time the coated abrasive disc 10 is detached for removal and replacement after it is spent. It is an important feature of the present invention that the support member is not in any way threadably attached to the drive member 30. It should be recognized that the support pad 32 along with the abrasive disc 10 is rotatable with respect to the drive member 30. As a result, the abrasive disc 10 and the support pad 32 may be rotated by hand to attach the nut 18 to the threads 28 on the end of the drive member 30. Also, the together (or simultaneously) support pad along with the disc may be rotated in the opposite direction by hand once the disc is spent to remove the nut 18 from the threaded end 28 of the drive member 30.

Figure 2:
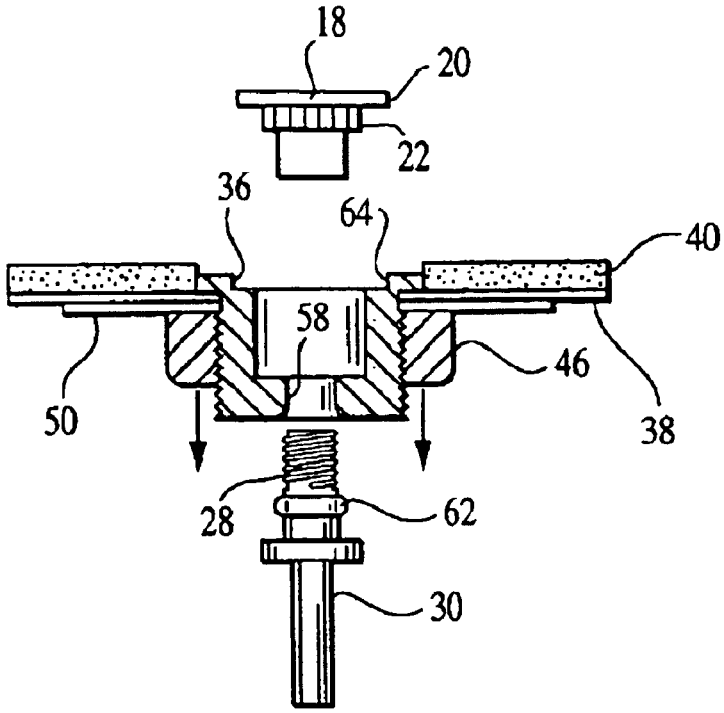
FIG. 2 is a partially exploded view of the structure as illustrated in FIG. 1.

Referring now, more particularly, to FIG. 2, the apparatus in accordance with the present invention is illustrated in partially exploded schematic fashion without the abrasive disc. The same reference numerals are utilized for the same parts as set forth in the description of FIG. 1. By reference to FIG. 2, the recess on the end of the cylinder adjacent the flange 36 is more clearly shown at 64. The flange 20 on the nut 18 seats within the recess 64 with the coated abrasive disc trapped between the flange 20 and the bottom of the recess 64 to thus cause the flange 20 to be positioned below the outer surface of the abrasive disc so that it will not come into contact with the work piece. The irregular surface 22 constructed as a plurality of alternating ridges and grooves which cut through the edge of the aperture 35 in the abrasive disc 10 are more clearly illustrated in FIG. 2.

It should also become more clear from the illustration shown in FIG. 2 that the only threaded engagement with the drive member 30 which is interconnected to the power tool at any portion of the mounting member is between the threads 28 on the drive member 30 and the internal threads on the bore of the nut 18.

Figure 3:
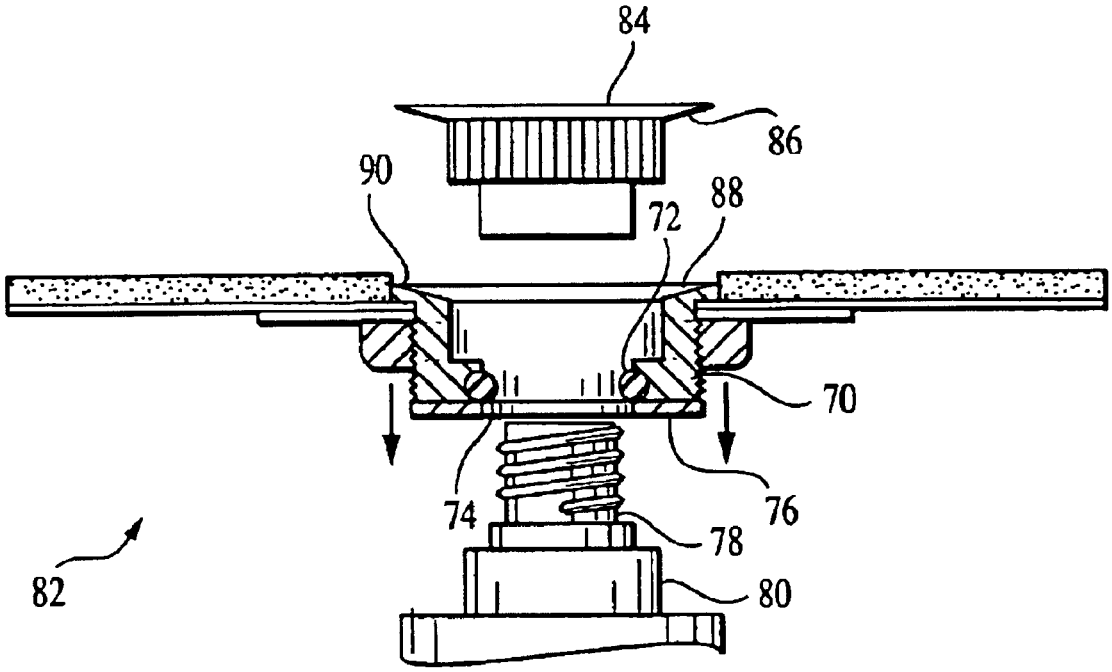
FIG. 3 is a partially exploded view of an alternative embodiment of a mounting structure in accordance with the present invention.

By referring now to FIG. 3, there is illustrated a partially exploded view similar to that of FIG. 2 but with a modified mounting device adapted for use with larger abrasive discs. As is shown in FIG. 3, a hollow cylindrical member 70 defines a recess or groove 72 therein which receives an O-ring 74. As is illustrated, a washer like member 76 is adhered to the cylindrical member 70 either by being physically attached or the like and traps the O-ring 74 in place. The O-ring 74 engages the threads which appear on the shaft 78 of the power tool spindle 80 and assists in holding the support member 82 on the power tool spindle during the time the spent abrasive disc is being removed, discarded, and replaced with a new abrasive disc. Also, the nut 84 used with this embodiment is slightly larger and constructed to include a tapered surface 86 which substantially mates with the recess 88 formed on the surface of the cylindrical member 70 adjacent the flange 90 which is used to grip the support pad in place.

Figure 4:
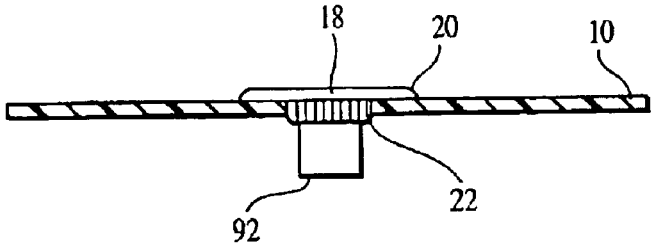
FIG. 4 illustrates an abrasive finishing disc with the nut of the present invention secured thereto.

Referring now more particularly to FIG. 4, the cooperative relationship between the abrasive disc 10 and the nut 18 is better illustrated. As is shown therein, the shank 92 of the nut 18 has formed thereon the irregular surface 22 in the form of alternating ridges and grooves which preferably are substantially parallel to the longitudinal axis of the nut 18. When the nut 18 is forced into place through the central aperture formed in the abrasive disc 10, the ridges cut into the surface defining the central aperture in such a way that an interference fit is formed between the nut 18 and the central aperture in the abrasive disc 10. The interference fit then provides the ability to turn the disc 10 and at the same time, turn the nut 18 so that the threads formed internally in the bore provided therein engage the threads 28 on the drive member 30 thus, pulling the flange 20 on the nut 18 down and into the recess 64 carrying with it that portion of the abrasive disc 10 immediately surrounding the aperture through which the shank 92 has been extended thereby clamping the disc 10 in place on the support pad 32 for use. It should be understood that those skilled in the art that the abrasive disc 10 may be constructed of any coated abrasive material know to those skilled in the art. For example, the disc 10 may be formed of cloth, paper, vulcanized fiber, or the like.

Figure 5A:
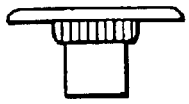
FIGS. 5A, B and C illustrates three embodiments of an attachment nut constructed in accordance with the principles of the present invention.
Figure 5B:
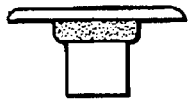
Figure 5C:
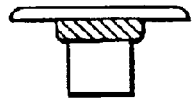

Referring now, more particularly, to FIGS. 5A, B and C there is illustrated three different embodiments of nuts which could be used in accordance with the principles of the present invention. In FIG. 5A, the nut having the alternating ridges and grooves is illustrated. In FIG. 5B, an irregular surface is provided in the form of elastomeric cylinder surrounding the barrel of the nut below the flange. In FIG. 5C the irregular portion can be enlarged greatly with respect to the size of the aperture through the abrasive disc or may have ridges and grooves arranged in a manner other than parallel to the axis as shown or alternatively the area immediately below the flange may be enlarged to a diameter greater than the aperture in the disc to provide an interference fit without any irregularities in the surface.

Figure 6:
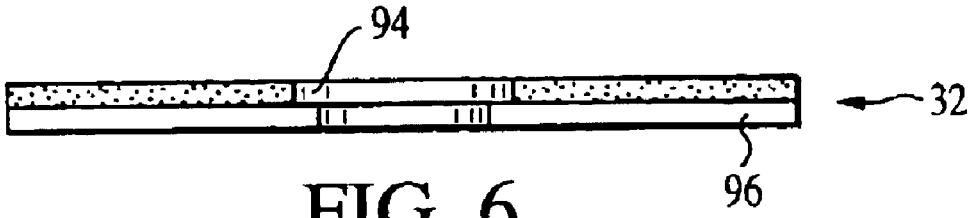
FIG. 6 illustrates in cross-section schematically one embodiment of a support pad constructed in accordance with the principles of the present invention.

Referring now, more particularly, to FIG. 6, the support pad 32 is shown in greater detail and the reduced diameter area is shown more clearly at 94. The plastic material of the support pad 32 as shown at 96 may be any type of plastic material desired but preferably, would be molybdenum disulfide filled nylon material.

Figure 7:
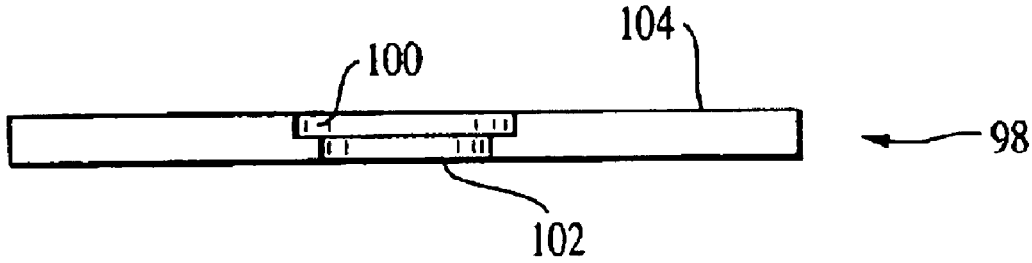
FIG. 7 illustrates an alternative embodiment of such a support pad.

As shown in FIG. 7, the support pad 98 could be formed totally of the molybdenum disulfide filled nylon with the reduced diameter section 100 thereof adjacent the opening 102 therethrough. As is evident in the structure shown in FIG. 7, the surface 104 of the support pad 98 does not have a surface formed of an elastomeric material or any other material which could provide a gripping surface with regard to the coated abrasive disc. The pad of the type shown in FIG. 7 would be utilized with a larger coated abrasive disc than would the pad in FIG. 6.

Figure 8:
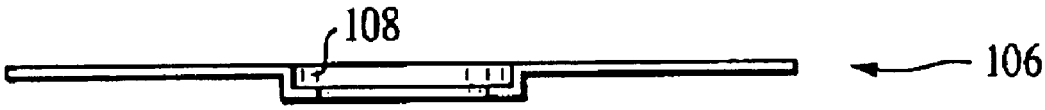
FIG. 8 illustrates yet another alternative embodiment of a support pad constructed in accordance with the present invention.

There is shown in FIG. 8 yet another pad 106 which is much thinner but also may be formed of a suitable plastic material which has been formed to provide the reduced diameter portion 108.

There has thus been disclosed a mounting device for a coated abrasive finishing article in the form of a coated abrasive disc which may be reused indefinitely and which permits easy attachment and detachment by hand without the use of tools for the replacement of spent abrasive discs. The mounting device is constructed in such a manner that the nut for attaching the abrasive disc to the support member is recessed below the surface of the abrasive disc and thus will not contact a work piece during use.

What is claimed is:

1. A mounting apparatus for rotatably securing a coated abrasive finishing article (10) having a first surface (12) coated with abrasive material and a second uncoated surface (14) and defining a centrally located first aperture (16), having an edge (24) therethrough, to a power tool drive member (30) which includes a support member having a support pad (32) for engaging said second surface, a nut (18) having a body extending through said aperture for threadably engaging said power tool and said body having an outwardly extending first flange (20) at one end engaging said first surface characterized by:

the body of said nut having (a) an outer irregular surface (22) adapted to engage said edge (24) of said aperture (16) in a substantially interference fit, and (b) a centrally disposed threaded bore (26) for engagement with said power tool drive member (30);

the support pad defining a centrally located second aperture (35) therethrough and having a face (34) for engaging said second surface, said pad having a reduced thickness region adjacent and surrounding said second aperture; and said support member further including a hollow externally threaded cylinder (42) having a second outwardly extending flange (36) at one end thereof and a compression ring (46) defining internal threads, said second flange being received within said reduced thickness region and said compression ring being threadably received on said external threaded cylinder to secure said support pad upon said cylinder, said one end of said cylinder defining a recess (64) for receiving said first flange so that when assembled in operational configuration on said power tool, said flange is below said first surface so as not to engage a work piece.

2. A mounting apparatus as defined in claim 1 wherein said face of said support pad is formed of material adapted to provide frictional engagement with said second surface.

3. A mounting apparatus as defined in claim 2 wherein said material is an elastomeric material.

4. A mounting apparatus as defined in claim 1 wherein said support pad is formed of semi-rigid material.

5. A mounting apparatus as defined in claim 1 wherein said outer irregular surface is formed by a plurality of alternating ridges and grooves.

6. A mounting apparatus as defined in claim 5 wherein said outer irregular surface is disposed only at said one end adjacent said flange.

7. A mounting apparatus as defined in claim 6 wherein said ridges are substantially parallel to the axis of said body and when said nut is inserted through said first aperture said ridges cut into said edge of said first aperture to form said substantially interference fit.

8. A mounting apparatus as defined in claim 1 wherein said support member further includes at least one removable disk (38, 50) disposed between said support pad and said compression ring to provide greater rigidity to said support member.

9. A mounting apparatus as defined in claim 8 wherein said at least one disk is formed of a semi-rigid plastic material.

10. A mounting apparatus as defined in claim 9 wherein said material is molybdenum disulfide filled nylon.

11. A mounting apparatus as defined in claim 8 which further includes at least one additional disk formed of metal.

12. A mounting apparatus as defined in claim 11 wherein said metal disk is positioned for engagement by said compression ring and which further includes an elastomeric washer (52) disposed between said compression ring and said metal disk.

13. A mounting apparatus as defined in claim 1 which further includes an elastomeric member (62, 72) for interfacing between said power tool drive member and said cylinder to assist in retaining said support member on said drive member during the time abrasive finishing articles are changed.

14. A mounting apparatus as defined in claim 13 wherein said elastomeric member is carried by said hollow cylinder.

15. A mounting apparatus as defined in claim 13 wherein said elastomeric member is carried by said drive member.

16. A mounting apparatus as defined in claim 1 wherein said hollow cylinder includes a through bore defining a recess adjacent the other end thereof, and an "O" ring seated within said recess for engaging the drive member to assist in retaining said support member on said drive member when coated abrasive finishing articles are changed.

* * * * *